United States Patent [19]

Kositzke

[11] 4,142,557

[45] Mar. 6, 1979

[54] SYNTHETIC PAPERMAKING FABRIC WITH RECTANGULAR THREADS

[75] Inventor: Robert H. Kositzke, Appleton, Wis.

[73] Assignee: Albany International Corp., Albany, N.Y.

[21] Appl. No.: 892,479

[22] Filed: Apr. 3, 1978

Related U.S. Application Data

[63] Continuation of Ser. No. 781,736, Mar. 28, 1977, abandoned.

[51] Int. Cl.[2] ..... D03D 15/02; D21F 1/10; B01D 39/08

[52] U.S. Cl. ..... 139/425 A; 139/420 R; 162/DIG. 1; 245/8

[58] Field of Search ..... 139/425 A, 425 R, 420 R, 139/383 A, 383 R; 162/DIG. 1, 348, 349, 358; 245/8, 10, 2; 34/95

[56] References Cited

U.S. PATENT DOCUMENTS

| | | | |
|---|---|---|---|
| 2,003,123 | 5/1935 | Specht | 139/425 A |
| 3,139,119 | 6/1974 | Buchanan | 139/425 A |
| 3,164,514 | 1/1965 | Day | 139/425 A |
| 3,238,594 | 3/1966 | Schuster | 139/383 A |
| 3,309,265 | 3/1967 | Krake | 139/383 R |
| 3,346,465 | 10/1967 | Franck | 139/425 A |
| 3,545,705 | 12/1970 | Hodgson | 139/425 A |
| 3,632,068 | 1/1972 | Weir et al. | 139/425 A |
| 3,716,138 | 2/1973 | Lumsden | 245/8 |
| 3,858,623 | 1/1975 | Lefkowitz | 139/425 A |
| 3,915,202 | 10/1975 | Curtis et al. | 139/425 A |

FOREIGN PATENT DOCUMENTS

| | | | |
|---|---|---|---|
| 582321 | 11/1946 | United Kingdom | 245/8 |
| 980288 | 1/1965 | United Kingdom | 139/420 R |

*Primary Examiner*—James Kee Chi
*Attorney, Agent, or Firm*—Quarles & Brady

[57] ABSTRACT

A papermaking fabric for use on a papermaking machine is shown that is woven from warp and weft threads of monofilament synthetic material in which the threads of the warp system are of substantially rectangular configuration in cross section.

9 Claims, 5 Drawing Figures

Fig. 5
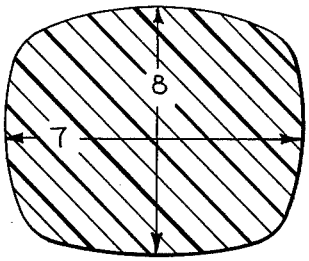
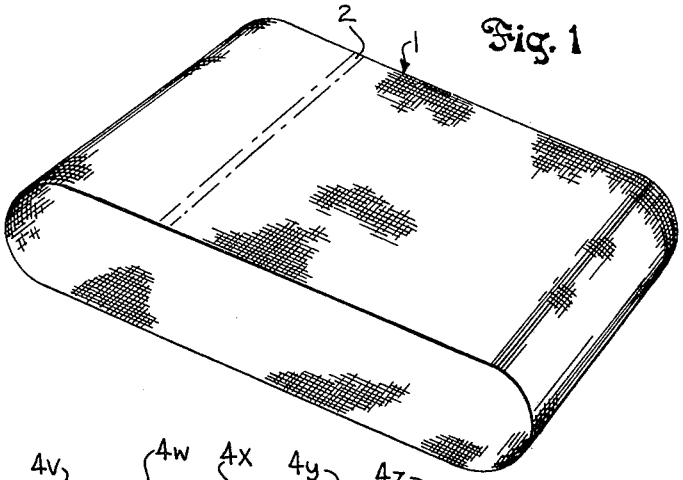
Fig. 1
Fig. 2
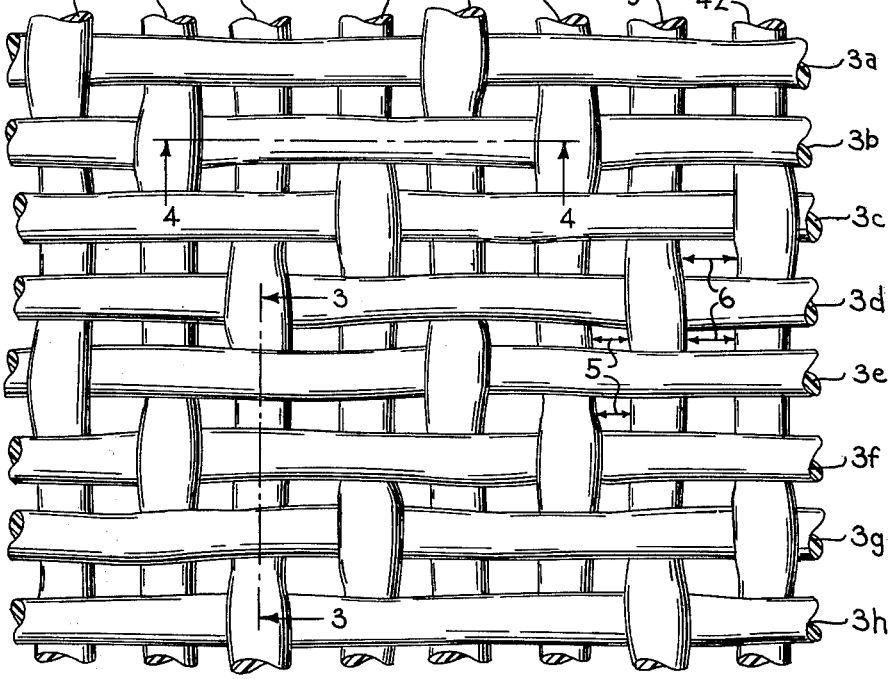
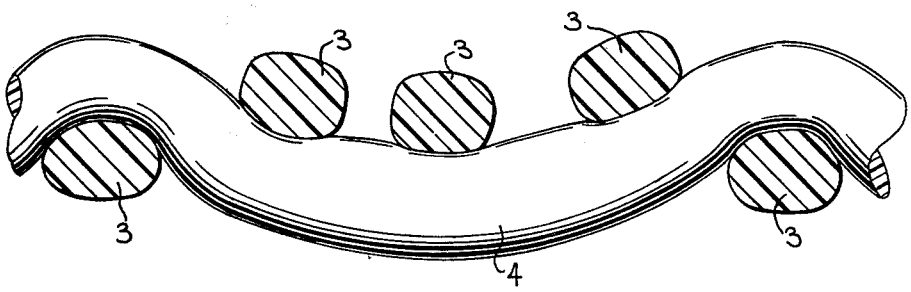
Fig. 3
Fig. 4
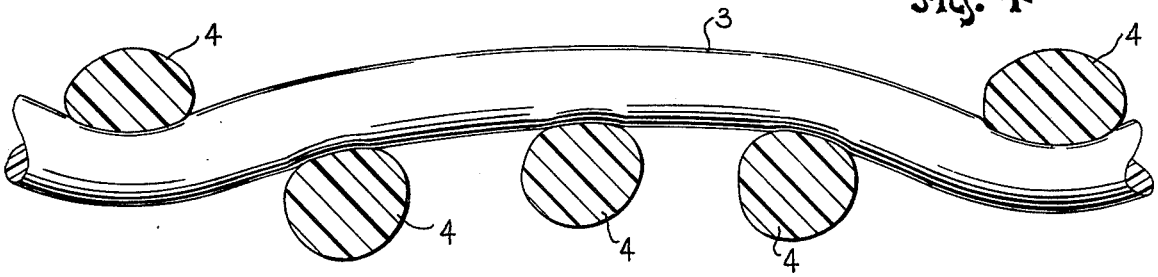

SYNTHETIC PAPERMAKING FABRIC WITH RECTANGULAR THREADS

CROSS REFERENCE TO RELATED CASE

This application is a continuation of application Ser. No. 781,736 filed Mar. 28, 1977 now abandoned.

BACKGROUND OF THE INVENTION

1. Field of Invention

The present invention relates to papermaking fabrics woven from synthetic materials to be used primarily in the wet end, or forming section of a papermaking machine, although use of these fabrics may also extend to other applications.

In the usual flat bed type papermaking machine the wet end, or forming section is known as a Fourdrinier. Paper pulp is deposited from a headbox upon a large foraminous screen in the form of an endless belt that is propelled over and around machine rolls, dewatering devices, suction boxes and other machine elements. The pulp is carried away from the headbox and water drains through the belt to set up the initial paper web, and when the web arrives at the foot end of the Fourdrinier it releases from the belt, or fabric, to move successively through press and dryer sections of the papermaking machine to produce a dried paper sheet. The fabric of the present invention is primarily intended for use as such a screen in the Fourdrinier and other papermaking machines such as twin wire machines.

2. Description of Prior Art

Paperforming fabrics are commonly constructed of monofilament synthetic threads, and polyester is presently the prevalent material for these fabrics. The fabrics are woven in a variety of weave patterns, and in such mesh counts and thread diameters as to suit the particular machines and paper grade for which they are intended. Typical weave patterns include the semi-twill weave, in which threads of one thread system pass across two threads of the other thread system, then interlace through the fabric and pass across a single thread of the other system on the opposite side of the fabric. This weave may also be termed a three-harness weave in reference to the arrangement of the harnesses in the weaving loom. A more common weave configuration is the four-harness in which the threads of one system pass across three of the threads of the other system and then are interlaced to the opposite side of the fabric to pass across a single thread of the other thread system. Four-harness configurations can be arranged in a twill pattern or a broken satin pattern, or four-harness weaves can also be used in a full-twill pattern in which the threads of one system will pass across two threads of the other system on one side of the fabric and then interlace through the fabric to pass across two threads of the other system on the other side of the fabric. Five or more harnesses can also be employed for paperforming fabrics.

Synthetic threads, and fabrics from which they are made, have a tendency to stretch, or elongate when on a papermaking machine and subjected to the tension loads arising from driving the fabrics over and around the Fourdrinier machine elements. To overcome stretching steps are taken to minimize the crimp in the machine direction threads. One technique is to highly stretch the fabric in a thermosetting process subsequent to weaving that is a necessary part of the manufacturing process. This increases the fabric modulus, or resistance to stretch, so that subsequent elongation on the paper machine will be reduced. A second technique is to employ a weave pattern in which the machine direction threads do not interlace between the cross machine direction threads as frequently, and for this purpose it has been popular to resort to the four-harness weaves. The resultant reduction in transverse interlacing of the machine direction threads reduces the total crimp of the threads, so that elongation on the paper machine will be reduced. Resort to five-harness patterns is an extension of this practice to reduce total crimp, and at the same time, in both the four and five-harness weaves there is an adequate number of interlacings of the threads to form sufficient vertical crimp to render the fabric stable. By stable is meant the maintenance of individual threads in their position as woven, so that shoving and other thread displacement will not take place during the paper-making process. Adequate stability can also be achieved in these fabrics for holding seams in flat woven fabrics.

However, there is a tendency of threads to "twin" in the manufacture of monofilament synthetic fabrics in certain four and five-harness weaves. "Twinning" is a phenomenon in which threads extending in the same direction tend to pair-up with one another, so that as one views the fabric it becomes evident each thread is more closely spaced to a thread on one side than on the other. Twinning results in nonuniform spacing between threads and if this unevenness becomes excessive the pulp fibers arrange themselves on the fabric during the water draining process in a manner that wire mark on the finished paper becomes objectionable. This wire mark may be manifested by visible lines running across the finished paper where the space or gap between fabric threads is excessive, and this unsightly result is usually more noticeable in the weft thread direction than the warp thread direction. For paperforming fabrics that are woven flat and seamed these weft induced markings run in the cross machine direction.

The amount of twinning is determined by first measuring the distance between the wider spread threads at points along their lengths which are medial the threads of the other system, and then measuring the distance between the threads of a pair, and taking the ratio of these two measurements. Twinning may run as high as a ratio of 2.0 in the weft thread direction of flat woven fabrics, and at values in this vicinity and above paper marking usually becomes objectionable. The present invention is directed toward the reduction of twinning as one of its several objectives.

The invention is also directed to facilitating the seaming operation in the manufacture of flat woven synthetic fabrics. In flat weaving the fabric is woven as a long flat piece of goods, and after removal from the loom the two ends are brought together and joined by a seam to form an endless belt. Seams for synthetic fabrics are usually formed by removing a plurality of weft threads at each end of the fabric, then interdigiting the exposed warp threads and weaving additional weft threads into them with the same weave pattern as the rest of the fabric. This weaving of a seam is a manual process requiring a high degree of skill and dexterity, and is extremely time consuming. The warp ends must be kept straight and separated from one another during the seaming process, and curl, twisting or entanglement of the warps with one another frustrates efficient manufacture.

The present invention aids in minimizing entanglement of warp threads, so that seaming can be carried out more efficiently. To achieve this goal, the invention employs warp threads that have generally rectangular cross section configurations. It has been found that such a configuration will improve the ability of warp ends to lie straight in the direction of the fabric without curling and twisting.

SUMMARY OF THE INVENTION

The instant construction of a paperforming fabric employs monofilament synthetic threads in which the warp threads in their cross section configuration are substantially rectangular with the lengthwise direction of this rectangular configuration extending in the plane of the fabric and the narrower height direction being normal to the plane of the fabric.

Warp threads of rectangular, or flattened cross sectional shape have long been used in papermaking fabrics composed of metal threads. In Specht, U.S. Pat. No. 2,003,123, thin, flat warp threads are used to obtain flat paper supporting surfaces and equal knuckle height. Buchanan, U.S. Pat. No. 3,139,119, employs flat warp to help obtain crimp when the weft threads are of a stiff metal. Day, U.S. Pat. No. 3,164,514, shows a non-woven fabric in which threads are rectangular to obtain better adhesive bonds between threads which are laid one on top of the other. Schuster, U.S. Pat. No. 3,238,594, employs metal weft threads in plastic fabrics with angular cross sections to be used especially for making seams. Krake, U.S. Pat. No. 3,309,265, shows a non-woven metal fabric with non-rectangular, oblique surfaces for the threads that affect water drainage. Franck U.S. Pat. No. 3,346,465, shows a rectangular thread which has a flat surface electrolytically coated to improve fabric life. Hodgson, U.S. Pat. No. 3,545,705, has stainless steel warp threads flattened to facilitate weaving and to reduce stress. Weir, U.S. Pat. No. 3,632,068, combines a special bronze with oval shaped threads to improve flexural fatigue. In synthetic monofilament fabrics knuckles of circular threads have been ground on the paperforming surface to make greater imprints in absorbent type papers. These purposes are not the primary goal of the present invention.

The present invention seeks to resolve problems peculiar to and confronting synthetic monofilament fabrics. One objective is to reduce the twinning of weft threads through the introduction of warp threads shaped with a rectangular cross section. This has no antecedent in the paperforming fabric art, either metal or synthetic, and it has been an unexpected result of the use of rectangular cross section warp threads to achieve this improvement.

A further object of the invention is to facilitate the seaming of flat woven fabrics, and this again is a result of introducing warp threads of rectangular like cross section for synthetic monofilament fabrics.

Another object is to achieve a fabric that has an improved tendency to lay flat on a papermaking machine. There will then be less tendency to form waves or ridges, there will be better contact with the machine elements such as foils, other dewatering devices, and the driving and return rolls. As a result the fabric will run better, water drainage is more uniform, and sheet contact is improved.

Additional advantages have also resulted from the use of rectangular cross section warp. The finished fabric is not as sleazy, and in weaving loom tensions may be reduced. This latter result apparently stems from the ability of the warp to crimp easier if the cross section area of the threads remains the same and the lengthwise direction of the rectangle lies in the plane of the fabric.

The foregoing and other objects and advantages of the invention will appear from the following description. In the description, reference is made to the accompanying drawing which forms a part hereof, and in which there is shown by way of illustration and not of limitation a preferred embodiment of the invention. Such embodiment does not represent the full scope of the invention, but rather the invention may be employed in many different embodiments, and reference is made to the claims herein for interpreting the breadth of the invention.

BRIEF DESCRIPTION OF THE DRAWING

FIG. 1 is a perspective view of a flat woven paperforming fabric embodying the present invention, FIG. 2 is a plan view of a portion of the fabric of FIG. 1 on an enlarged scale and taken from the paper supporting side of the fabric, FIG. 3 is a view in section of a portion of the fabric taken through the center line of a cross machine direction thread, which is a weft thread in the present instance of a flat woven fabric, FIG. 4 is a view in cross section of a portion of the fabric taken through the center line of a machine direction, or warp, thread, and FIG. 5 is an enlarged view in cross section of a rectangular warp thread as used in the invention.

DESCRIPTION OF THE PREFERRED EMBODIMENT

FIG. 1 shows a paperforming fabric 1 that was woven flat and joined at its ends by a seam 2 to form an endless belt. Being flat woven, the warp threads 3 run in the lengthwise, or machine direction of the belt, this direction being defined as the direction in which the fabric will travel when on a papermaking machine. Weft threads 4 then run in the widthwise or cross machine direction, which is parallel to the seam 2. Each of the thread systems, the warp system and the weft system, is comprised of extruded, synthetic monofilament threads. Polyester threads are the preferred material, but other materials may be used, so long as they exhibit requisite characteristics of strength, sufficient modulus to resist elongation, adequate resistance to chemical attack from paper pulp, low rates of liquid absorption, etc.

The particular fabric of the drawing has been woven in a four-harness satin weave, and an enlarged fragmentary view of the paper supporting surface is seen in FIG. 2. Warp threads 3, sublabeled "a" through "h", extend in the machine direction, and the weft threads 4, sublabeled "s" through "z" extend perpendicular thereto. FIG. 3 is a cross section of the fabric taken along one of the weft threads 4, while FIG. 4 is a cross section of the fabric taken along one of the warp threads 3.

As seen particularly in FIG. 4, a warp thread 3 passes over a group of three weft threads 4 and then interlaces downwardly through the weft threads 4 to pass beneath a single weft thread 4. The warp thread 3 then interlaces in the upward direction to repeat the pattern of passing over a set of three weft threads 3 and then under a single thread 3. Thus, the fabric 1 is arranged with the long warp knuckles on the outer, or paper supporting face of the fabric 1. Conversely, as seen in FIG. 3, a weft thread 4 passes under a set of three warp threads 3, then interlaces upwardly between the warp threads 3 and passes over a single warp thread 3, and then interlaces again toward the bottom side of the fabric 1 to repeat its pattern. The flat woven fabric 1 could be turned in the opposite sense, of having the long warp knuckles on the inner or wear face of the fabric, so that the long warp knuckles of the weft threads 4 would be on the paper supporting face of the fabric. It has become customary to provide flat woven, seamed fabrics in either of these two arrangements, depending upon a customer's need.

In FIG. 2 it is seen that the short weft knuckles are arranged in a one-two-four-three sequence, which is the characteristic of the well known satin weave. The short warp knuckles will be in a like sequence, and so are the long knuckles of each thread system. This is an irregular knuckle pattern, as contrasted with the regular progression of thread knuckles that occurs in twill weaves, such as 1-2-3 in semi-twill fabrics, or 1-2-3-4 in four-harness twills. In the irregular knuckle patterns, which may be defined as having thread knuckles other than in a regular progression, there is a tendency for both the weft and the warp threads to twin. For example, in FIG. 2 the weft threads **4*t* and 4*u* are relatively close together to form a pair. The threads 4*v* and 4*w* are similarly paired, and the threads 4*x* and 4*y* make still another pair. The spaces between the threads 4*u* and 4*v* and 4*w* and 4*x* are greater than between the threads of any of the pairs. Similarly, the warp threads 3 have a tendency to pair-up in the weaving of this fabric pattern, with threads 3*b* and 3*c* forming a first pair, the threads 3*d* and 3*e* forming a second pair, and threads 3*f* and 3*g* constituting another pair. The degree of twinning of the weft threads 4 is measured by determining the average distance between a pair of twinned threads at points midway between threads of the warp system, such as indicated by the measurement lines 5 in FIG. 2, and dividing this average distance into the average distance between non-paired threads, as indicated by the measurement lines 6 in FIG. 2**. When twinning ratios run as high as 2.0 for fabrics woven of conventional circular threads the wire marking on the finished paper can be quite objectionable. It is consequently desirable to reduce the twinning ratio, so that the adverse effects upon paper formation and paper marking is correspondingly reduced.

The weft threads 4 are of usual circular cross section monofilaments, but as seen in FIG. 5, the warp threads 3 have an initial cross section configuration that is substantially rectangular. FIG. 3 indicates that some slight distortion of the rectangular threads 3 may take place during manufacture at the cross over points where they bear against the weft threads 4, so that the rectangularity of a finished thread 3 at the cross overs may not be as clear and as pronounced as prior to weaving. The rectangularity will be retained along the rest of the warp thread lengths, but for the purpose of defining rectangularity in the present invention the cross sectional shape prior to weaving is of particular significance, since it allows measurements and definition of the thread without interference or masking by any distortion that may occur in the manufacturing process. The sides of the rectangular configuration need not be straight lines, but can be bowed with some degree of convexity, and still be deemed to be rectangular. The lengthwise direction of the rectangle lies substantially, or is measured, in the plane of the fabric, so that it is in the widthwise direction of the fabric. The narrower dimension, constituting the height of the rectangle, is generally in the direction normal to the plane of the fabric. The lengthwise dimension of the rectangle, such as indicated by line 7 in FIG. 5, should be larger than the height dimension, as measured by the measurement line 8 in FIG. 5, by a ratio of at least 1.2. The lengthwise dimension 7 may have a value of the same order of magnitude as the diameter of a circular warp thread would have in a fabric of like mesh count, i.e., number of warp threads per inch. The cross section area for the rectangular configuration may also remain at the same order of magnitude as for a circular thread. Thus, a flat warp monofilament of 0.0086 inch by 0.007 inch, which has a length to height ratio of 1.23, and a cross section area of 0.0000602 sq. in., compares with a circular thread of 0.0086 in diameter having an area of 0.0000577 sq. in. This is a difference in cross section areas of only 4.3 percent, and it has been found that the invention may be practiced with this corresponding relationship of substantially the same diameter, area and mesh count for the warp thread system as previously existed for circular warp threads.

As shown in FIG. 3, the long sides of the rectangular cross section areas of the three warp threads 3 crossed by a long float knuckle of the weft 4 lie firmly against the inside of the weft float knuckle. The interfaces will be tight due to the tensioning and vertical crimping of the warp threads 3 that occurs in weaving, and by the lengthwise thread shrinkage that takes place in thermosetting. As a result, a substantially long interface is created at each cross over between a warp thread 3 and the inner side of a long weft knuckle which will restrict the warp thread 3 from twisting or rocking out of its position. The warp threads will resist rotational forces about their centers, and it has been observed that fabrics woven with rectangular cross section warp threads lie unusually flat on a papermaking machine. It is believed this fabric flatness may result from the resistance of a rectangular geometry to twisting forces, because of the comparatively straight line interface with accompanying tight engagement between the threads to resist thread rotation. Also, the presence of corners in the rectangular geometry of the warp threads 3 that bear against the weft threads 4 make tipping or twisting of a thread more difficult than if the warps 3 were of circular configuration. The warp thread resistance to torquing, or twisting also causes the projecting warp ends being woven into a seam to lie straighter, without the same propensity to twist and curl, as would occur in circular threads. A rectangular cross section of the same area as that of a circular thread also has a greater net moment of gyration about its geometric center, which may further enhance the flatness and twist resistance characteristic of the invention.

An unforeseen result has been the reduction in twinning, particularly weft thread twinning. In irregular thread knuckle patterns, such as in the four-harness satin, the knuckle pattern gives rise to uneven forces acting upon the threads during weaving, such that different weft threads being beat into the fabric will be struck and driven different amounts. The resulting uneven beat distance between threads produces twinning. The use of rectangular warp threads has been found to reduce the uneveness of the beat distance of the weft, probably, in retrospect, because the thinner cross section height allows the warp to crimp easier to accommodate the beating in of the weft.

For comparable circular warp and rectangular warp fabrics of the same mesh, i.e., warp threads per inch, in which the circular warp diameter and the rectangular warp lengthwise dimension are kept the same the reduction in weft twinning has been substantial. For example the twinning ratio in circular warp fabrics was averaging 1.88 in a 68 mesh fabric, and the ratio dropped to 1.2 for a rectangular cross section warp fabric. For fabrics of the invention, the twinning ratio is less than about 1.5.

It has also been found that with rectangular cross section warp the warp loom tension can be reduced and the power requirements for beating the lay becomes less. Control over weaving is enhanced, and there is less stress on the loom. Loom control over the beats, or weft, per inch is thereby improved. Another result which has been observed with rectangular warp threads is an increase in fabric permeability. The water drainage rate is greater, and this allows the fabric designer to increase the number of weft threads per inch to correspondingly increase paper support. An additional advantage can be obtained by having the warp and weft knuckles on the wear side in a common plane, so that the flat warp knuckles are in contact with the driving roll of the papermaking machine. Then, the traction between the roll and the fabric is increased, so as to minimize slippage of the fabric and abrasive wear that results from slippage. Thus, the utilization of warp threads of rectangular cross section in synthetic fabrics provides a number of distinct advantages.

I claim:

1. A papermaking fabric woven from warp and weft thread systems of synthetic monofilament material with the threads of each thread system interlacing through the threads of the other thread system in an irregular knuckle pattern with short knuckles on one fabric face and long knuckles on the opposite fabric face, the improvement therein of:

the threads of one thread system being of substantially rectangular cross section before weaving with a width extending generally in the plane of the fabric that is greater than the height of the rectangular configuration;

said width exceeding said height by a ratio of greater than 1.2;

the cross section area of said rectangular configuration being of the same order of magnitude as that of a circular thread having a diameter equal to the width of the rectangular configuration; and the widthwise sides of the threads having said rectangular configuration being in engagement with the inner surfaces of the long knuckles of the other thread system to form a relatively long knuckle interface along said widthwise sides that resists rotational thread movement.

2. A fabric as in claim 1 woven in a four harness satin weave.

3. A fabric as in claim 1 having a twinning ratio for said other thread system of less than about 1.5.

4. In a woven papermaking fabric having synthetic monofilament warp and weft thread systems with the weft threads extending in the widthwise direction of the fabric and being of circular cross section, the combination therewith of:

the warp threads extending in the lengthwise direction of the fabric and being of substantially rectangular cross section before weaving with the widthwise side of the rectangular shape being generally in the plane of the fabric and at least 1.2 times the height of the rectangular shape;

the warp threads interlacing through the weft threads to form an irregular knuckle pattern with short knuckles on one fabric face and long knuckles on the opposite face, the weft threads correspondingly having an irregular knuckle pattern with short knuckles on one fabric face and long knuckles on the opposite face; and said widthwise side of said rectangular warp threads bearing against the inner surfaces of long weft knuckles in tight engagement therewith to form a substantially long knuckle interface.

5. A fabric as in claim 4, wherein the cross section area of said substantially rectangular threads is about the same order of magnitude as the area of a circular thread having a diameter equal to the width of such rectangular threads.

6. A fabric as in claim 4, woven in a four harness satin weave.

7. In a woven papermaking fabric having synthetic monofilament warp and weft thread systems with the threads of a first thread system being of circular cross section, the combination therewith of:

the threads of the second thread system being of substantially rectangular cross section before weaving with the widthwise side of the rectangular shape being generally in the plane of the fabric and at least 1.2 times the height of the rectangular shape;

the threads of the second thread system interlacing through the threads of the first thread system to form an irregular knuckle pattern with short knuckles on one fabric face and long knuckles on the opposite fabric face, the threads of the first thread system correspondingly having an irregular knuckle pattern with short knuckles on one fabric face and long knuckles on the opposite face; and said widthwise side of said rectangular threads bearing against the inner surfaces of the long knuckles of the other threads in tight engagement therewith to form a substantially long knuckle interface.

8. A fabric as in claim 7 having a twinning ratio for the first thread system of less than about 1.5.

9. A papermaking fabric of interwoven warp and weft thread systems comprised of synthetic monofilament threads; the threads of one thread system being of substantially rectangular cross section before weaving with the widthwise side of the rectangular configuration being at least 1.2 times the height thereof; the thread systems being interwoven with one another with an irregular knuckle pattern; and a side of the rectangular configuration of each rectangular thread lying generally in the plane of the fabric and bearing against threads of the other thread system to resist rotational thread movement.

* * * * *